US005742883A

United States Patent [19]

Girard et al.

[11] Patent Number: 5,742,883

[45] Date of Patent: Apr. 21, 1998

[54] PRODUCT INTEGRATED RETURN MAILER

[75] Inventors: James J. Girard, Boise; Darius Boockholdt, Meridian, both of Id.

[73] Assignee: Hewlett-Packard Company, Palo Alto, Calif.

[21] Appl. No.: 691,076

[22] Filed: Jul. 31, 1996

[51] Int. Cl.[6] ..... B65D 27/06

[52] U.S. Cl. ..... 399/262; 229/92.8; 229/301

[58] Field of Search ..... 206/410; 399/262; 229/92, 92.8, 921, 92.1, 306, 68.1, 300, 301

[56] References Cited

U.S. PATENT DOCUMENTS

| | | | |
|---|---|---|---|
| 304,661 | 9/1884 | Pedrick | 229/92.1 |
| 401,210 | 4/1889 | Reed | 229/92 |
| 480,582 | 8/1892 | Hardy | 229/92 |
| 562,336 | 6/1896 | Munn | 229/92 |
| 598,290 | 2/1898 | Hinchman | 229/92 |
| 1,639,566 | 8/1927 | Johnson | 229/92.1 |
| 1,801,155 | 4/1931 | Harson | 229/92.1 |
| 1,943,074 | 1/1934 | Heyman | 229/92 |
| 2,491,227 | 12/1949 | Sugar | 229/92.8 |
| 2,497,064 | 2/1950 | Baynes | 229/92.8 |
| 2,642,182 | 6/1953 | Baynes | 229/92.8 |
| 3,278,015 | 10/1966 | Bernstein | 229/301 |
| 3,380,644 | 4/1968 | D'alessio | 229/92.8 |
| 3,557,519 | 1/1971 | Lyon, Jr. | 229/92.1 |
| 3,820,447 | 6/1974 | Gandron et al. | 229/301 |
| 3,998,138 | 12/1976 | Walters | 229/92.1 |
| 4,640,411 | 2/1987 | Fery | 383/127 |
| 5,117,976 | 6/1992 | Whitt et al. | 206/446 |
| 5,239,805 | 8/1993 | Uchida et al. | 53/469 |

*Primary Examiner*—Stephen P. Garbe
*Attorney, Agent, or Firm*—Lane R. Simmons

[57] ABSTRACT

An integrated product mailing system comprises a product to be mailed and a mailer enclosure secured to the product for enclosing and mailing the product once the product is spent. In a preferred embodiment, a toner cartridge for a laser printer includes a cavity disposed in the cartridge, a mailer enclosure disposed in the cavity, and means for removably securing the mailer enclosure in the cavity, whereby the mailer enclosure may be removed from the cavity to be used for easily and efficiently surrounding, enclosing and mailing the product. The mailer enclosure is folded, compacted, or deflated in the cavity, and unfolded upon use for enclosing the product. An access cover secures the mailer in the cavity, and the cavity is integrated into the cartridge for functional efficiency and aesthetic presence of the cartridge and mailer combination.

20 Claims, 6 Drawing Sheets

PRODUCT INTEGRATED RETURN MAILER

FIELD OF THE INVENTION

This invention relates to packaging and mailing and, more particularly, to integrating a return mailer into a product such as a toner cartridge for a laser printer wherein the cartridge is to be shipped to a return destination after use.

BACKGROUND OF THE INVENTION

Electrophotographic processes for producing a permanent image on media are well known and commonly used. In general, a common process includes: (1) charging a photoreceptor such as a roller or continuous belt bearing a photoconductive material; (2) exposing the charged area to a light image to produce an electrostatic charge on the area in the shape of the image; (3) presenting developer particles (toner) to the photoreceptor surface bearing the image so that the particles are transferred to the surface in the shape of the image; (4) transferring the particles in the shape of the image from the photoreceptor to the media; (5) fusing or fixing the particles in the shape of the image to the media; and (6) cleaning or restoring the photoreceptor for the next printing cycle.

Many image forming apparatus utilize this well known electrophotographic printing process, examples being laser printers, copy machines, and facsimile machines. As described above, these image forming apparatus use toner, or the "ink" of the imaging process, to print or copy the desired image or words onto a piece of paper or media. The toner is contained in a hopper (reservoir), and is eventually depleted after a certain number of printing processes. For example, the toner in a conventional laser printer might be depleted after printing approximately 1000 pages. However, the depletion number depends on several factors, such as the type and density of images being printed, volume of the toner hopper, etc.

Certain imaging systems provide a refillable toner hopper. However, the refilling process has proven to be difficult and messy because the toner is a powdery substance. Further, since toner must be applied evenly across the surface of the photoconductive drum during use, any toner that leaks or spills out of the hopper can accumulate on the drum and cause blotching, streaking or voiding of prints and copies. Toner leakage/spills can also cause moving parts to wear out more rapidly and may even short out the electrical components in the imaging system. In these ways, toner may reduce the quality of prints and copies, increase maintenance cost, and can even decrease the useful life of the image forming machine.

To resolve the problems associated with toner refilling, a disposable toner cartridge is often used in certain imaging systems, such as laser printers. This cartridge typically includes a toner hopper, seal assembly, mounting member, magnetic roller assembly, photoconductive drum assembly and corona assembly. By combining these components in to a single cartridge, toner is applied equally across the surface of the drum without leaking out of the hopper during handling. Unfortunately, this cartridge design is relatively expensive. In addition, the magnetic roller, drum and corona assemblies may last considerably longer than the toner. Thus, the disposal of the entire cartridge results in unnecessary waste of material and landfill space, with the costs being passed on to the consumer.

Refurbishing a spent (used) toner cartridge for reuse or recycling purposes, or simply refilling the toner hopper, is often more cost effective than throwing away the empty cartridge and purchasing a completely new unit. This reusing (or recycling) is also considered by many to be more environmentally advantageous. However, the toner cartridge must typically be returned to a refurbishing/refilling manufacturer, via some carrier entity, to have any waste toner emptied, new toner added, and any other worn components repaired as necessary.

Although reusing toner cartridges has its advantages, there is the disadvantage of a user having to procure proper packaging and shipping materials to wrap the spent cartridge in. Further, the actual process of packaging, addressing and shipping the cartridge often proves problematic because of its size and shape, and because of the need for determining the manufacturer's (or refilling entity's) proper mailing address.

A conventional scheme for simplifying and improving the toner cartridge reuse process is for a manufacturer to include a self adhesive address label inside the consumer packaging (usually a box) of the newly manufactured or reused/refilled cartridge. This label displays the shipping address of the refill manufacturer. After the packaging is opened for accessing, removing and using the toner cartridge, the label is placed on the outside of the original shipping box. When the toner cartridge is spent, it is put back inside the box, taped (or tied or sealed) shut, and delivered to (or picked up by) a mail carrier entity for delivery to the refill manufacturer identified on the address label. As such, the same box that was used to ship the cartridge upon a consumer purchase is reused to return the cartridge for refill purposes.

Theoretically, the first box can be thrown away, and when a new (refilled) toner cartridge is purchased, the old cartridge is put in the new box and returned to the manufacturer—hence there is no need to keep track of the empty box and label for long lengths of time. For users that have only a small number of printers this theory works to some degree. However, for users (larger entities) with many printers, it is often difficult to keep track of all the boxes and labels.

Accordingly, an object of the present invention is to provide an improved means for allowing a consumer to return a spent toner cartridge to a manufacturer or refill entity for recycling/reuse purposes.

SUMMARY OF THE INVENTION

According to principles of the present invention, an integrated product mailing system comprises a product to be mailed and a mailer enclosure secured to the product for enclosing and mailing the product. In a preferred embodiment, a toner cartridge for a laser printer includes a cavity disposed in the cartridge, a mailer enclosure disposed in the cavity, and means for securing the mailer enclosure in the cavity, whereby the mailer enclosure may be removed from the cavity to be used for easily and efficiently surrounding, enclosing and mailing the product.

According to further principles, the mailer enclosure is folded, compacted, or deflated in the cavity, and unfolded upon use for surrounding, enclosing and mailing the product. In addition, the mailer enclosure is preaddressed for return mailing the cartridge. Furthermore, the cartridge/cavity includes an access cover for securing the mailer in the cavity, and the cavity and access cover are integrated into the cartridge for functional efficiency and aesthetic presence of the cartridge and mailer combination.

Other objects, advantages, and capabilities of the present invention will become more apparent as the description proceeds.

DETAILED DESCRIPTION OF THE INVENTION

Figure 1:
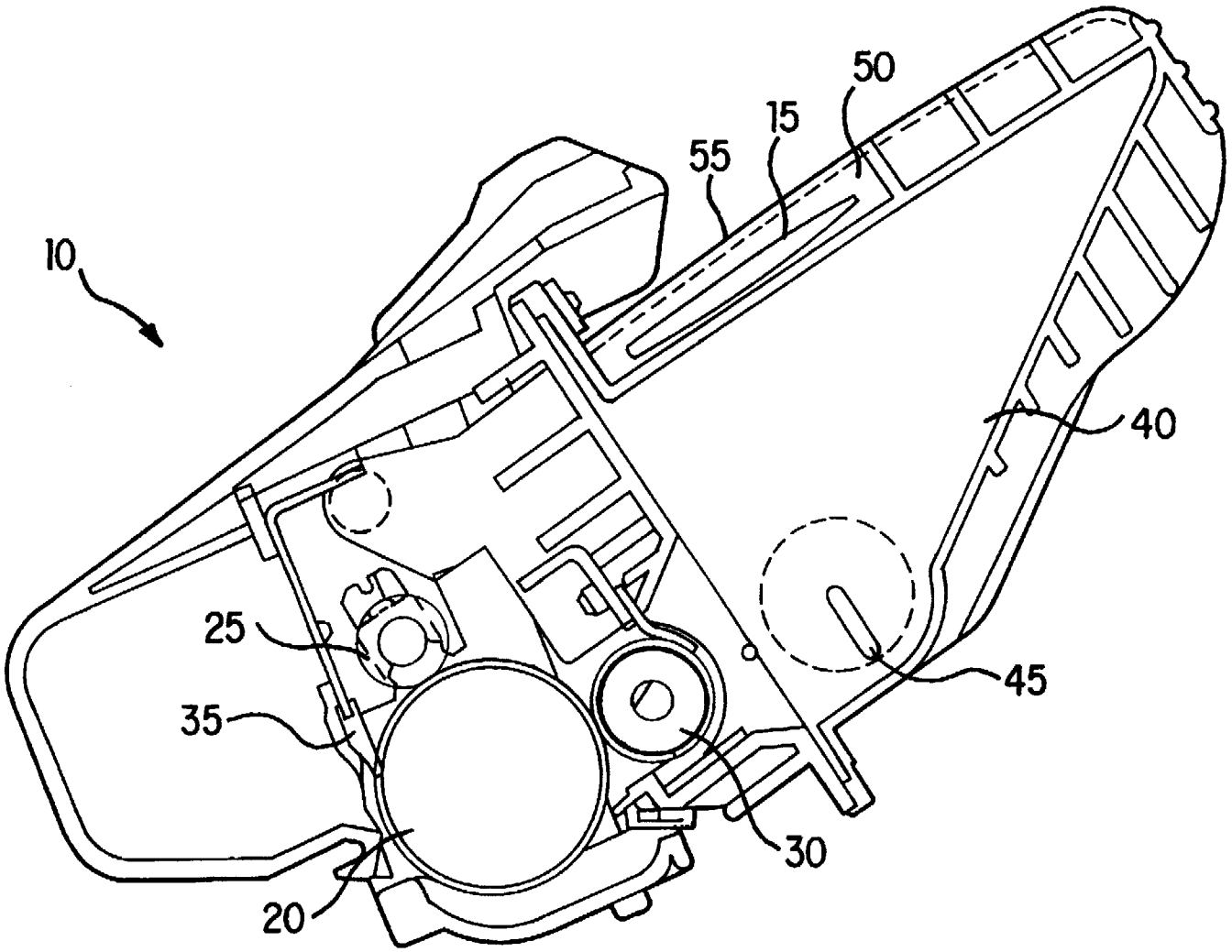
FIG. 1 is a cross sectional elevation view of the present invention toner cartridge and integrated return mailer.

FIG. 1 is a cross sectional elevation view of the present invention laser printer toner cartridge 10 and integrated return mailer enclosure 15, together forming an improved product mailing system. Although the present invention product integrated return mailer is disclosed in particular reference to a laser printer toner cartridge, it is obvious that the principles are equally applicable to other products that may be mailed, shipped or sent, either for use or reuse of the product, whereby the process of packaging, addressing and mailing the product is clearly simplified.

Cartridge 10 includes photoconductive drum roller 20, charge roller 25, developer 30, cleaning blade 35, and toner reservoir (hopper) 40 with toner agitator 45. Further included are the novel aspects of the integrated return mailer enclosure 15 foldably disposed in cavity 50 of cartridge 10. Mailer enclosure 15 is secured in cavity 50 by removable access cover 55. In a preferred embodiment, mailer enclosure 15 is a strong, flexible bag, made of a material such as Mylar. As shown, mailer 15 is folded or compressed into cavity 50 for storage purposes upon original purchase and during use of the cartridge. However, when cartridge 10 is spent (i.e., toner reservoir 40 is empty), mailer 15 is easily removed from cavity 50 and the cartridge is inserted into the mailer for mailing purposes, such as to a refurbishing or refilling entity.

Also in a preferred embodiment, cavity 50 is molded as an integral part of cartridge 10. Access cover 55 is formed so as to securely attach to cartridge 10 over cavity 50, such as by pressing, snapping or latching over the cavity, and such that mailer 15 is secured in cavity 50. It is preferred that mailer 15 be secured to cartridge 10 in a manner such that the functional operation of the cartridge is not disturbed in connection with its intended use in a laser printer. Likewise, it is preferable to form the cavity, pocket, or other similar means for securing mailer 15 to cartridge 10 such that the appearance of cartridge 10 remains aesthetically attractive.

Figure 2:
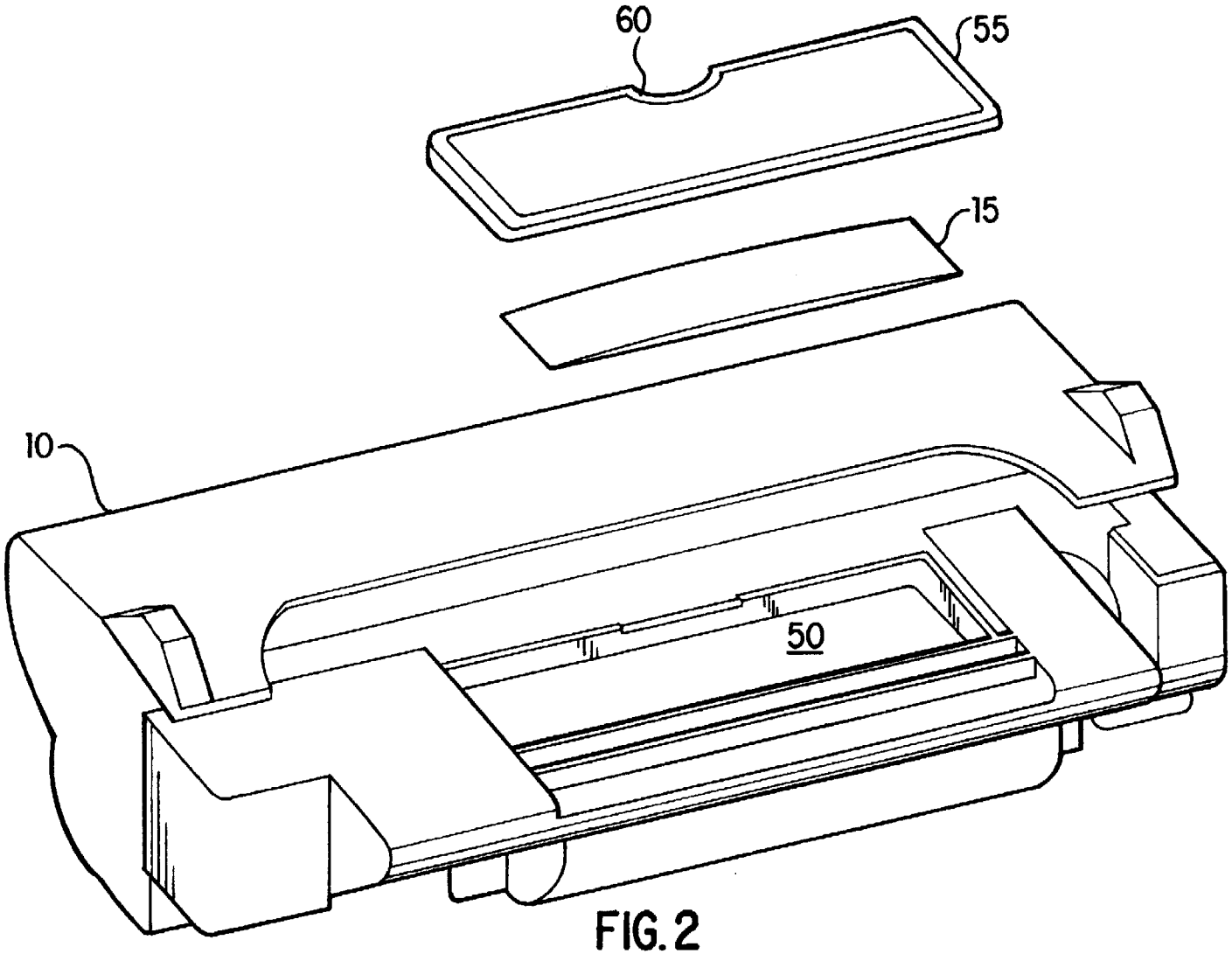
FIG. 2 is an exploded perspective view of the present invention with the return mailer in its compacted form and the cartridge cavity access cover removed.

FIG. 2 is an exploded perspective view of toner cartridge 10 showing return mailer 15 in its folded/compacted form and being removed from cavity 50 of cartridge 10 along with cavity access cover 55. In this embodiment, access cover 55 is a lid that is completely removable from cavity 50 of cartridge 10. However, it could just as equally remain attached to cavity 50 upon being opened, for example, by a type of hinge means. Further, in this embodiment, access cover 55 is formed to snugly interfit with cavity 50, although other means for securing it in place would work equally as well, such as latching, screwing, etc. In this embodiment, recess 60 of access cover 55 provides an easy means for removing/opening the cover for accessing mailer 15 in cavity 50. However, as obvious to those of ordinary skill in the art, these elements are variable in implementation and somewhat subject to arbitrary design criteria relative to ease of use, functionality, and aesthetic desires.

Figure 3:
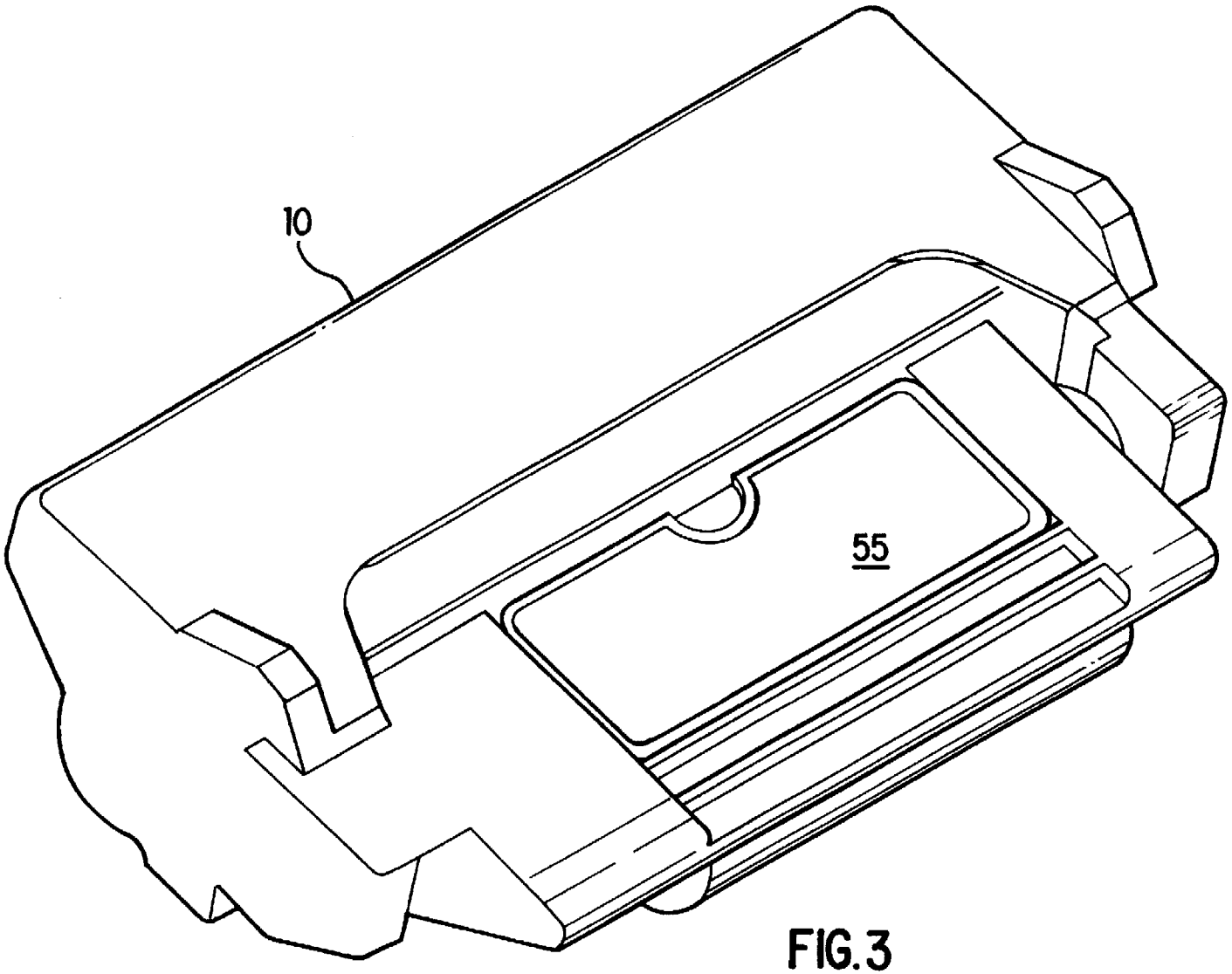
FIG. 3 is a perspective view with the access cover in place enclosing the return mailer and cartridge cavity.

FIG. 3 is also a perspective view of cartridge 10 showing access cover 55 disposed in place for enclosing and securing the return mailer in the cartridge cavity. This depiction presents the aesthetically pleasing features of a preferred embodiment integrated product return mailer. This embodiment also demonstrates how the return mailer is, preferably, integrated into cartridge 10 without distracting from the functional purposes of the cartridge.

Figure 4:
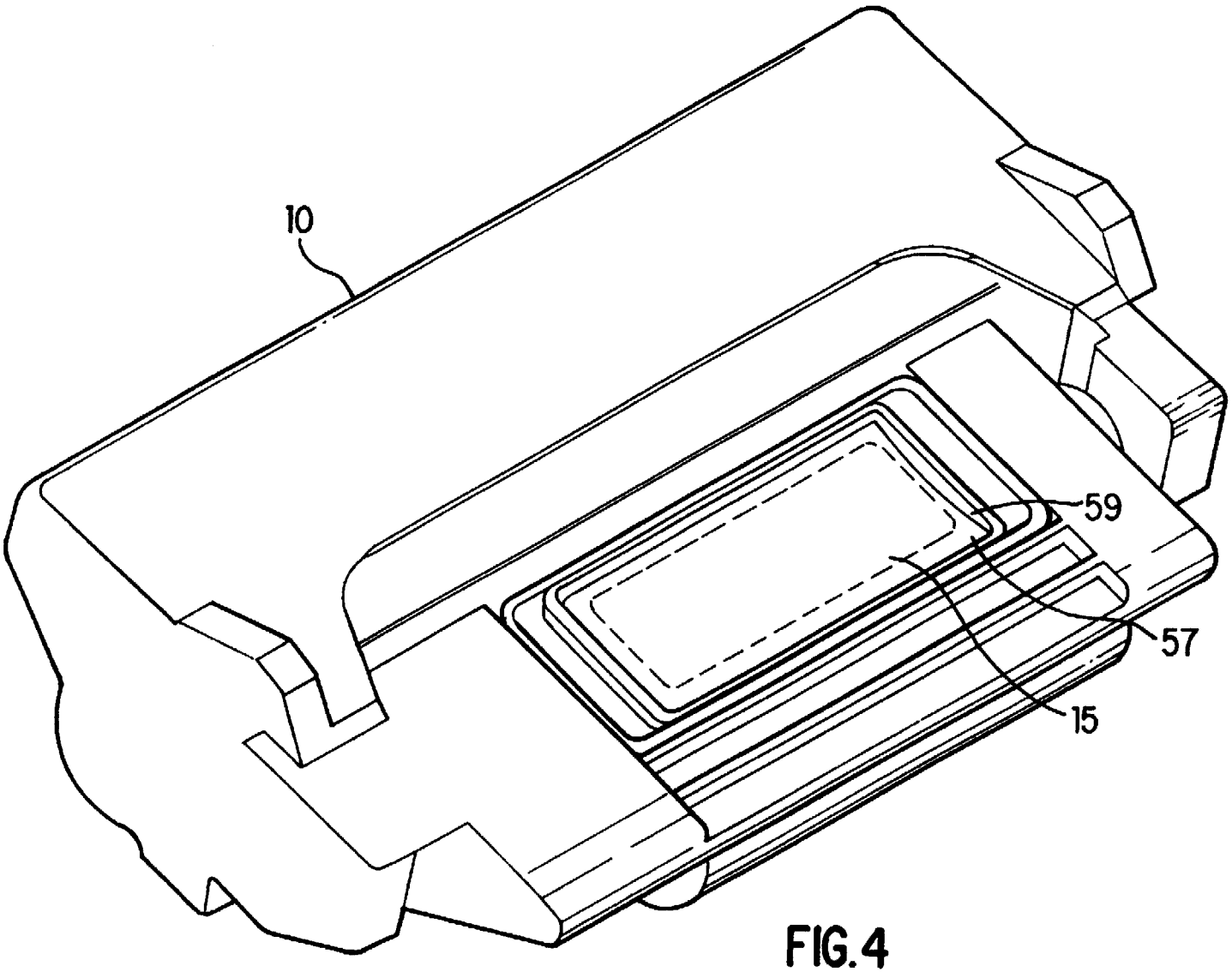
FIG. 4 is a perspective view showing a pocket means attached to the cartridge as an alternate embodiment for securing the return mailer.

FIG. 4 is a perspective view of an alternate embodiment showing pocket 57 attached to an external portion of cartridge 10 for securing return mailer 15 (shown in phantom) thereto. Pocket 57 is any conventional pocket type holding means, made of a flexible plastic material or the like, and is attached to cartridge 10 by glue or other conventional means in the art. Mailer enclosure 15 is folded, and is secured within and extracted from pocket 57 through mouth 59 of the pocket. This embodiment demonstrates an alternative to molding or forming a cavity in the cartridge (as shown in FIGS. 1–3), and again demonstrates how mailer 15 is secured to cartridge 10 without interfering with the functional purposes of the cartridge.

Although FIGS. 1–3 identify cavity 50 and access cover 55 as one means for indirectly securing mailer 15 to cartridge 10, and FIG. 4 identifies pocket 57 as an alternate means, it is obvious that other means for securing mailer 15 to cartridge 10 may also be used. For example, mailer 15 may be held in a folded (compacted) position by some form of strapping means, and the mailer may itself be secured directly to a surface of cartridge 10 (such as with an adhesive), rather than being indirectly secured to the cartridge (such as stored in a cavity of the cartridge or in a pocket attached to the cartridge). As such, mailer 15 may be "secured" to cartridge 10 in any number of ways, either directly or indirectly, so long as the mailer is not easily separated (lost) from the cartridge, and so long as the cartridge remains operatively functional having the mailer secured thereto.

Figure 5:
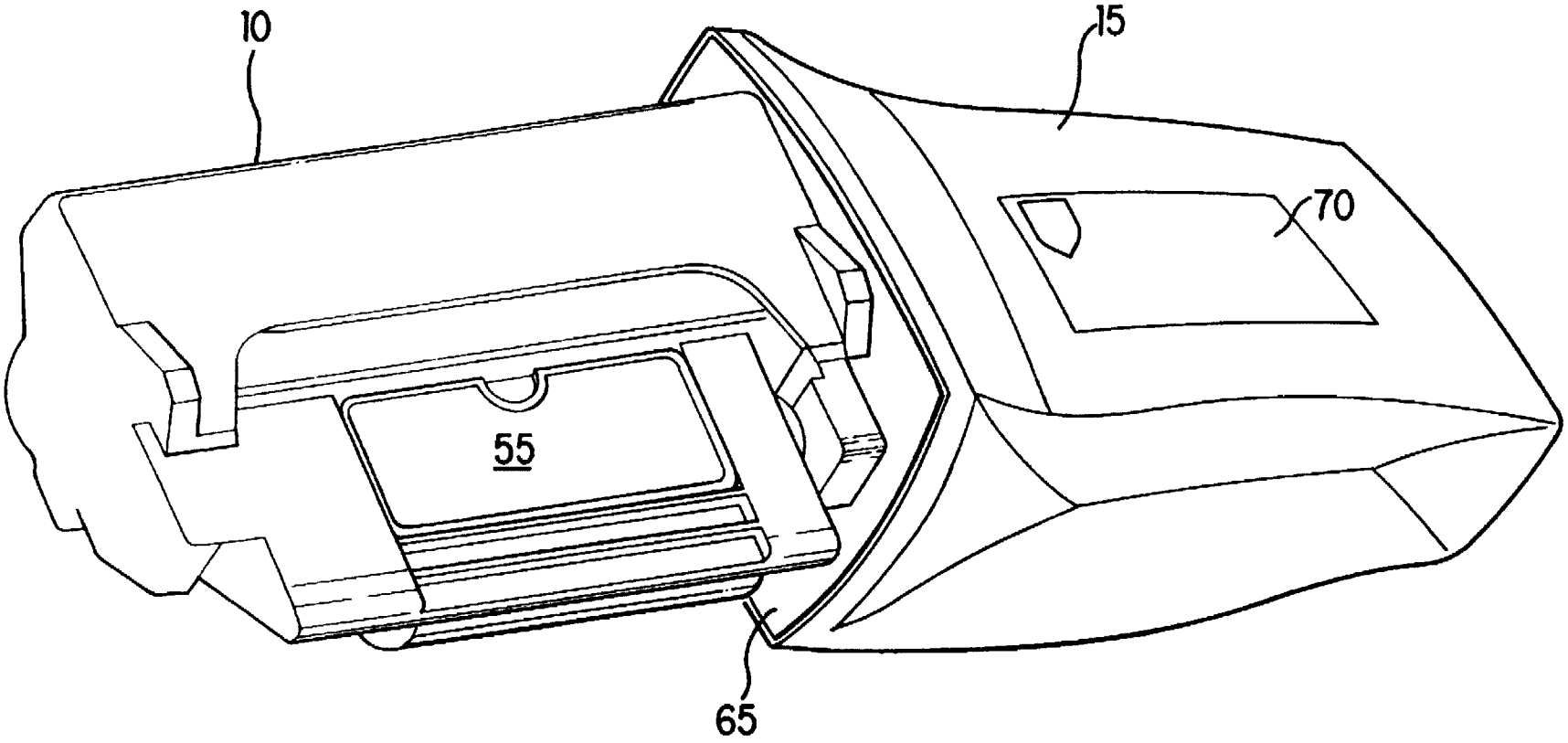
FIG. 5 is a perspective view showing the return mailer unfolded to an open position for enclosing the toner cartridge for return mailing purposes.

Referring now to FIG. 5, a perspective view shows return mailer 15 positioned in an opened (or uncompacted, unfolded or inflated) state for enclosing toner cartridge 10 for return mailing purposes. As previously indicated, in a preferred embodiment, mailer enclosure 15 is a strong, flexible bag, made of a material such as Mylar. Although not shown, mailer 15 could equally be a padded bag, or a type of an inflatable bag for providing improved, padded protection to cartridge 10 when the cartridge is inserted in the bag for mailing purposes. Mailer 15 is flexible or expandable to form a size and shape sufficient to substantially surround and enclose cartridge 10 for mailing purposes. Preferably, however, mailer 15 completely encloses cartridge 10, and further includes self sealing means 65 for securely enclosing the cartridge. Sealing means 65 may be any of a variety of conventional sealing means, such as a peelable strip adhesive, resealable zip lock, or clip means.

Mailer enclosure 15 further includes, in a preferred embodiment, address portion 70 available for use in displaying an address for return mailing the cartridge. Specifically, address portion 70 may be, selectively, (i) a preaddressed address visibly disposed on or imprinted as part of the address portion of mailer 15, or, (ii) a preferred location on mailer 15 for placement of an address label. In either case the address identifies the mailing address of the manufacturer or entity to which the toner cartridge may be mailed (shipped or sent) for refurbishing, refilling, or recycling for reuse, such as when the toner in reservoir 40 (FIG. 1 ) is depleted, or for any other reason or at any other time when the cartridge needs to be mailed back to the identified entity.

Figure 6:
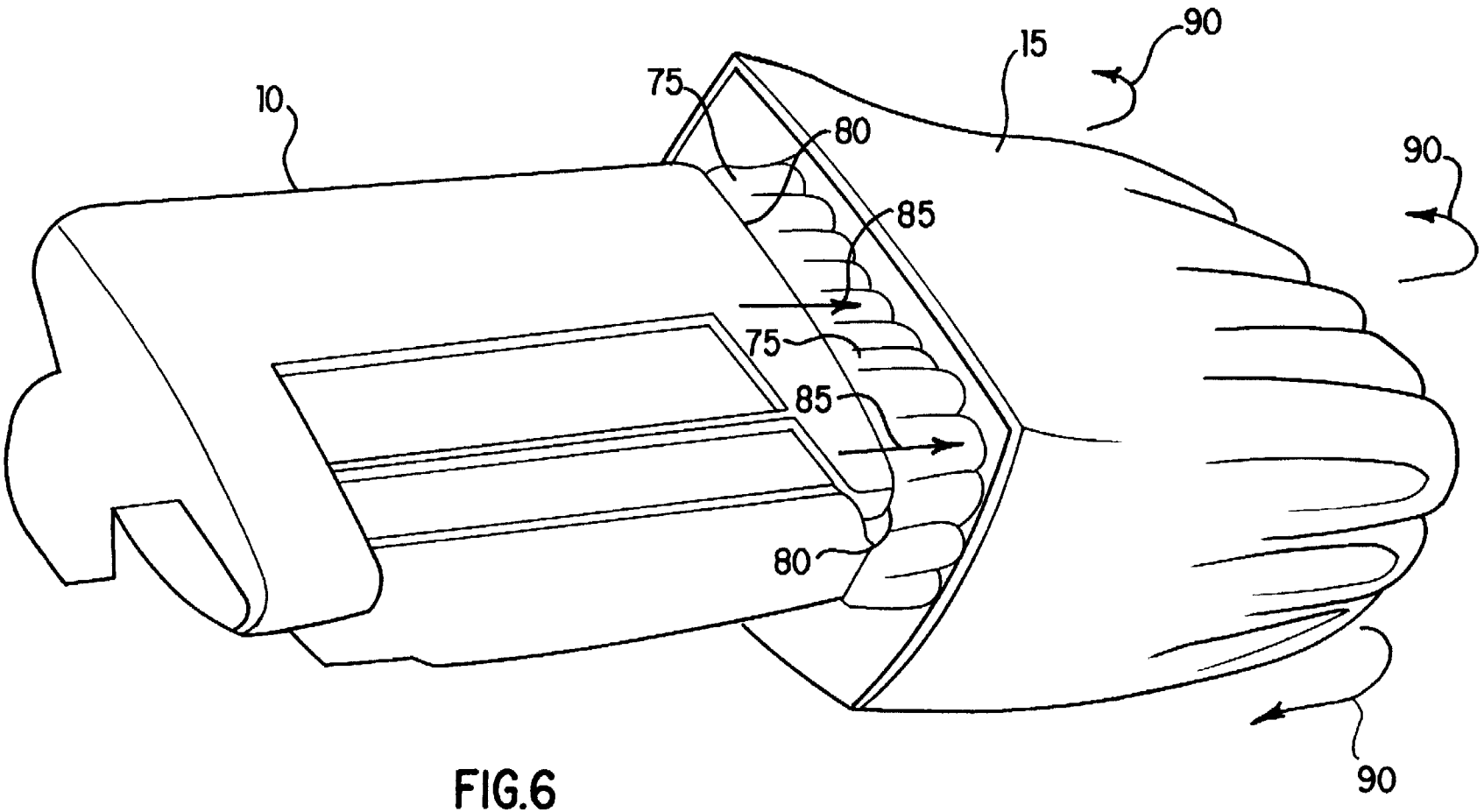
FIG. 6 is a perspective view showing the return mailer permanently attached to the toner cartridge, yet positioned to enable enclosure of the cartridge.

FIG. 6 is a perspective view of an alternate embodiment showing return mailer 15 permanently attached to toner cartridge 10 yet positioned to enable enclosure of the cartridge. Having mailer 15 permanently attached provides another means for ensuring that it is not separated from cartridge 10 so that a consumer does not have to search for the mailer at a time when the cartridge is to be return mailed. In the embodiment depicted, a portion 75 of mailer enclosure 15 is permanently secured to a target location 80 of cartridge 10. Although portion 75 may be secured at a generally focused point, the depicted embodiment shows the mailer permanently attached around an end circumferential periphery 80 of cartridge 10. The depicted embodiment also suggests that mailer 15 is attached in a cavity (not shown, but similar to cavity 50 of FIG. 2) of cartridge 10 so as to not interfere with the functional operations of the cartridge. However, in FIG. 6 the cavity is formed at the end of cartridge 10 rather than on the top. The mailer is attached such that it can be pulled away (directional arrows 85) from the cartridge in a first direction (while remaining attached), and then positioned to somewhat invert upon itself (as shown by directional arrows 90) to substantially surround and enclose the product, referenced from the target location. In essence, the mailer is extracted from a cavity (or other securing means) and then manipulated and folded back on itself so as to surround cartridge 10.

Finally, usage of the present invention is simple, effective and efficient. Specifically, when the product (in this example, toner cartridge 15) needs to be return mailed (shipped via some carrier) for refurbishing, refilling, or some other purpose, a user simply removes access cover 55, removes mailer enclosure 15 from cavity 50 (FIGS. 1–3), unfolds and opens the mailer, places cartridge 10 into the mailer, closes (seals) the mailer, and then delivers the mailer with the enclosed product (cartridge) to the carrier identified by the preaddressed mailer. In using this integrated product mailer configuration, the user is relieved from the headache of searching for a package to hold the product, packaging the product and sealing the package, and also addressing the package.

In summary, what has been described above are the preferred embodiments for an integrated product mailing system. However, it should be understood that the foregoing description is only illustrative of the invention. Various alternatives and modifications can be devised by those skilled in the art without departing from the spirit and scope of the invention. For example, while the invention has been described in context of a laser printer toner cartridge, it is equally applicable to other types of products which may need to be mailed. Accordingly, the present invention is intended to embrace all such alternatives, modifications and variances which fall within the scope of the appended claims.

What is claimed is:

1. A product mailing system comprising:

(a) a product to be mailed, wherein the product is a toner cartridge; and, (b) a mailer enclosure secured to the product for use as a mailer for the product in the event of mailing the product.

2. The product mailing system of claim 1 wherein the mailer enclosure is secured to the product in a manner such that a functional operation of the product is not disturbed.

3. The product mailing system of claim 1 wherein the mailer enclosure is secured to the product as an integral part of the product.

4. The product mailing system of claim 1 wherein the mailer enclosure is, selectively, (i) removably secured to the product, or (ii) permanently secured to the product.

5. The product mailing system of claim 1 wherein a portion of the mailer enclosure is permanently secured at a specified target location on the product such that a remaining portion of the mailer enclosure may be positioned to substantially surround and enclose the product, referenced from the target location, in the event the mailer enclosure is being used for mailing the product.

6. The product mailing system of claim 1 wherein the mailer enclosure is secured, alternatively, (i) within a cavity of the product, (ii) within a pocket attached to the product, or (iii) directly to a surface of the product.

7. The product mailing system of claim 1 wherein the mailer enclosure is secured within a cavity of the product, and further including an access cover for the cavity for allowing and restricting access to the cavity and mailer enclosure.

8. The product mailing system of claim 1 wherein the mailer enclosure is formed from a material that is, alternatively, foldable, compactable, or inflatable, and wherein it is respectively folded, compacted, or deflated in a first state for minimizing prominence in connection with the product and for storage purposes with the product, and wherein the mailer enclosure is respectively unfolded, uncompacted, or inflated in a second state for purposes of substantially surrounding and enclosing the product in the event the mailer enclosure is being used for mailing the product.

9. The product mailing system of claim 1 wherein the mailer enclosure is formed such that it substantially surrounds and encloses the product in the event the mailer enclosure is being used for mailing the product.

10. The product mailing system of claim 1 wherein an address portion of the mailer enclosure is available for use in displaying an address in the event the mailer enclosure is being used for mailing the product.

11. The product mailing system of claim 10 wherein the address portion of the mailer enclosure includes a preaddressed address visibly disposed on or as part of the address portion.

12. The product mailing system of claim 10 further including a label having a preaddressed address visibly disposed thereon, and wherein the label is attachable to the address portion of the mailer enclosure in the event the mailer enclosure is being used for mailing the product.

13. A product comprising:

(a) alternatively, one of (i) a cavity formed in the product, or (ii) a pocket attached to the product;

(b) maiming means disposed in the respective cavity or pocket;

(c) means for securing the mailing means in the respective cavity or pocket, whereby the mailing means may be at least substantially removed therefrom and used for mailing the product in the event of mailing the product, and wherein the product is a toner cartridge.

14. The product of claim 13 wherein a portion of the mailing means is permanently secured to the product at a specified target location on the product such that a remaining portion of the mailing means may be positioned to substantially surround and enclose the product, referenced from the target location, in the event the mailing means is being used for mailing the product.

15. The product of claim 13 wherein the product comprises a cavity formed therein and the means for securing the mailing means includes an access cover for the cavity for allowing and restricting access to the cavity and mailing means.

16. The product of claim 13 wherein the mailing means is formed from a material that is, alternatively, foldable, compactable, or inflatable, and wherein it is respectively folded, compacted, or deflated in the respective cavity or pocket means for storage purposes, and is, respectively, unfolded, uncompacted, or inflated in the event it is removed from the respective cavity or pocket means for purposes of substantially surrounding and enclosing the product in the event the mailing means is being used for mailing the product.

17. The product of claim 13 wherein the mailing means includes an address portion for use in displaying an address in the event the mailing means is being used for mailing the product, and wherein the address portion includes, selectively, (i) a preaddressed address visibly disposed on or as part of the address portion, or (ii) a label disposed over the address portion, the label having a preaddressed address visibly disposed thereon.

18. An integrated toner cartridge and return mailer, comprising:

(a) a toner cartridge;

(a) a return mailer enclosure; and, (b) means for securing the return mailer enclosure to the toner cartridge such that the return mailer enclosure may be manipulated and used for substantially surrounding and enclosing the toner cartridge in the event of mailing the toner cartridge.

19. A product mailing system comprising:

(a) a product to be mailed, the product including a cavity and an access cover for the cavity for allowing and restricting access to the cavity; and, (b) a mailer enclosure removably secured within the cavity by the access cover, the mailer enclosure for use as a mailer for the product in the event of mailing the product.

20. A product comprising:

(a) a cavity formed in the product;

(b) an access cover for the cavity for allowing and restricting access to the cavity; and, (c) mailing means disposed in the cavity whereby the mailing means may be at least substantially removed therefrom and used for mailing the product in the event of mailing the product.

* * * * *